US005111998A

United States Patent [19]

Kanda et al.

[11] Patent Number: 5,111,998

[45] Date of Patent: May 12, 1992

[54] PROCESS FOR PRODUCING TONER FOR DEVELOPING ELECTROSTATIC IMAGE AND APPARATUS SYSTEM THEREFOR

[75] Inventors: Hitoshi Kanda, Yokohama; Yusuke Yamada, Machida; Masayoshi Kato, Iruma; Yasuhide Goseki, Yokohama; Satoshi Mitsumura, Tokyo, all of Japan

[73] Assignee: Canon Kabushiki Kaisha, Tokyo, Japan

[21] Appl. No.: 676,067

[22] Filed: Mar. 27, 1991

[30] Foreign Application Priority Data

Mar. 30, 1990 [JP] Japan ..... 2-80699

[51] Int. Cl.[5] ..... B02C 19/12

[52] U.S. Cl. ..... 241/5; 241/19; 241/24; 241/34; 241/39; 241/79.1; 241/80

[58] Field of Search ..... 241/5, 19, 24, 39, 78, 241/79.1, 80, 97, 34

[56] References Cited

U.S. PATENT DOCUMENTS

| | | | |
|---|---|---|---|
| 1,897,195 | 2/1933 | Howden . | |
| 3,877,647 | 4/1975 | Gorobets et al. | 241/39 |
| 4,153,541 | 5/1979 | Rumpf et al. | 209/143 |
| 4,221,655 | 9/1980 | Nakayama et al. | 209/211 |
| 4,784,333 | 11/1988 | Hikake et al. | 241/5 |
| 4,844,349 | 7/1989 | Kanda et al. | 241/19 |
| 4,989,794 | 2/1991 | Askew et al. | 241/16 |
| 5,016,823 | 5/1991 | Kato et al. | 241/5 |

FOREIGN PATENT DOCUMENTS

| | | |
|---|---|---|
| 2538190 | 3/1979 | Fed. Rep. of Germany . |
| 2949618 | 6/1981 | Fed. Rep. of Germany . |
| 3403940 | 6/1985 | Fed. Rep. of Germany . |
| 3346445 | 7/1985 | Fed. Rep. of Germany . |
| 2580831 | 4/1985 | France . |
| 2646791 | 11/1990 | France . |
| 54-48378 | 4/1979 | Japan . |
| 54-79870 | 6/1979 | Japan . |
| 54-81172 | 6/1979 | Japan . |

OTHER PUBLICATIONS

Ueda et al., "Dry Classifier With Collecting Chamber", Nagoya Industrial Science and Technology Lab. Reports, 8 [4], 235, 1959.

"Iitani's Classifier", Journal J.S.M.E., 59, [3], 215, 1956.

Patent Abstracts of Japan, vol. 12, No. 345 (p. 759) [3192], Sep. 16, 1988.

Patent Abstracts of Japan, vol. 13, No. 314 (p. 899)[3662], Jul. 18, 1989.

*Primary Examiner*—Mark Rosenbaum
*Assistant Examiner*—John M. Husar
*Attorney, Agent, or Firm*—Fitzpatrick, Cella, Harper & Scinto

[57] ABSTRACT

A toner for developing an electrostatic latent image is produced by classifying a pulverized feed material in a first classifying means into coarse powder and fine powder; pulverizing the coarse powder and feeding back the pulverized product to the first classifying means; introducing the fine powder to a second classifying means having a multi-division classification zone divided into at least three sections, where it is classified into a coarse powder portion, a median powder portion, and a fine powder portion; and feeding back the coarse powder to said pulverizing means or first classifying means. The median powder has a volume average particle diameter of from 4 μm to 10 μm and a coefficient of variation of number distribution, represented by A, satisfying the following condition: $20 \leqq A \leqq 45$, and the weights B, C, F, G and M are controlled to satisfy the expressions: $0.3 \leqq$ weight B/weight $C \leqq 0.8$, $0.2 \leqq$ weight G/weight $C \leqq 0.7$ and $0.8 \leqq$ weight B/(weight F + weight M) $\leqq 1.2$.

15 Claims, 9 Drawing Sheets

PROCESS FOR PRODUCING TONER FOR DEVELOPING ELECTROSTATIC IMAGE AND APPARATUS SYSTEM THEREFOR

BACKGROUND OF THE INVENTION

1. Field of the Invention

The present invention relates to a process and an apparatus system for producing a toner with a given particle size for developing electrostatic images, by efficiently pulverizing and classifying solid particles containing a binder resin.

2. Related Background Art

In image forming processes such as electrophotography, electrostatic photography and electrostatic printing, a toner is used to develop an electrostatic image.

As a process for producing an end product by pulverizing and classifying starting solid particles in the production of a toner for developing electrostatic image in which the end product is required to be of fine particles, the process as shown in a flow chart in FIG. 6 is commonly used. This process comprises melt-kneading given starting materials such as a binder resin, a coloring agent as exemplified by a dye, a pigment and a magnetic material, cooling the kneaded product to solidification, followed by pulverization to obtain pulverized solid particles as a pulverized feed material.

The pulverized feed material is constantly fed to a first classifying means and classified therein. A classified coarse powder maily comprised of coarse particles having a particle size above a prescribed range is fed to a pulverizing means and pulverized therein, and then the pulverized product is again fed back to the first classifying means.

The powder mainly comprised of particles having a particle size within other prescribed range and particles having a particle size below the prescribed range is fed to a second classifying means, and classified into a median powder mainly comprised of particles having the prescribed particle size and a fine powder mainly comprised of particles having a particle size below the prescribed particle size.

For example, in order to obtain particles having, for example, a volume average particle diameter of 8 μm and also a coefficient of variation of number distribution, represented by A as defined later, of 33, the starting material is pulverized to powder with a given average particle diameter and classified, using a pulverizing means such as an impact mill or jet mill quipped with a classifying mechanism for removing coarse powder, and the pulverized feed material from which the coarse powder has been removed is passed to another classifier, where a fine powder is removed to give the desired median powder.

The volume average particle diameter herein referred to is a measurement obtained by a Coulter counter Type TA-II, available from Coulter Counter, Inc. (U.S.A.), using an aperture of 100 μm.

Such conventional processes have the following problems. Particles from which coarse particles with a particle size above a prescribed range have been completely removed must be fed to the second classifying means provided for the purpose of removing the fine powder, and hence the pulverizing means necessarily bears a greater load, bringing about a smaller throughput. In order to completely remove the coarse particles with a particle size above a prescribed range, it tends to result in excessive pulverization after all. This leads to the problem that a phenomenon such as a lowering of the yield is caused in the subsequent second classifying means for removing the fine powder.

In respect of the second classifying means provided for the purpose of removing the fine powder, an aggregate constituted of ultrafine particles may be produced in some instances, and it is difficult to remove the aggregate as a fine powder. In such an instance, the aggregate may be mixed into the end product, resulting in a difficulty to obtain a product having a precise particle size distribution. Moreover, the aggregate may be disintegrated in a toner into ultrafine particles to give a cause to lower image quality.

Even if the desired product having a precise particle size distribution can be obtained using the conventional method, its process becomes complicated to cause a lowering of the yield of classification, necessarily resulting in a poor production efficiency and a product of high cost. This tendency increases with a decrease in the given particle size.

This tendency more increases when the volume average particle diameter is 10 μm or less.

Japanese Patent Application Laid-open No. 63-101859 (corresponding to U.S. Pat. No. 4,844,349) discloses a process and an apparatus for producing a toner, comprising a first classifying means, a pulverizing means and a multi-division classifying means used as a second classifying means. It, however, is sought to provide a process and an apparatus system for efficiently producing a toner having a volume average particle diameter of 10 μm or less.

SUMMARY OF THE INVENTION

An object of the present invention is to provide a production process that has solved the above various problems involved in the conventional processes for producing toners used for developing electrostatic images.

Another object of the present invention is to provide an apparatus system for efficiently producing a toner for developing electrostatic images.

Still another object of the present invention is to provide a process and an apparatus system for efficiently producing a toner for developing electrostatic image, having a precise particle size distribution.

A further object of the present invention is to provide a process and an apparatus system for efficiently and yieldingly producing a product of particles (used as a toner) having a given precise particle size distribution, from solid particles formed by melt-kneading a mixture containing a binder resin, a coloring agent and additives, cooling the kneaded product followed by pulverization.

A still further object of the present invention is to provide a process and an apparatus system for efficiently producing a toner for developing electrostatic images, having a volume average particle diameter of from 4 μm to 10 μm, and preferably from 4 μm to 9 μm.

The objects of the present invention can be achieved by a process for producing a toner for developing an electrostatic latent image, comprising the steps of:

melt-kneading a composition comprising at least a binder resin and a coloring agent, cooling the kneaded product to solidification, and pulverizing the solidified product to produce a pulverized feed material;

feeding the pulverized feed material to a first classifying means to classify the feed material into coarse powder and fine powder;

feeding the classified coarse powder to a pulverizing means and thereafter feeding back the pulverized product to the first classifying means;

introducing the classified fine powder to a second classifying means having a multi-division classification zone divided into at least three sections, to which the particles of the fine powder are allowed to fall along curved lines by the Coanda effect, where a coarse powder portion mainly comprised of particles having a particle size above a prescribed range is dividedly collected in a first divided section, a median powder portion mainly comprised of particles having a particle size within the prescribed range is dividedly collected in a second divided section, and a fine powder portion mainly comprised of particles having a particle size below the prescribed range is dividedly collected in a third divided section; and feeding back said classified coarse powder collected in the first divided section, to said pulverizing means or said first classifying means;

wherein said median powder collected in the second divided section has a volume average particle diameter of from 4 μm to 10 μm and a coefficient of variation of number distribution, represented by A, satisfying the following condition:

$$20 \leqq A \leqq 45$$

wherein A represents the coefficient of variation $(S/\overline{D}_1) \times 100$ in the number distribution of the median powder, wherein S represents the standard deviation in the number distribution of the median powder and $\overline{D}$ represents the number average particle diameter (μm) of the median powder; and when the weight per unit time of the pulverized feed material fed to the first classifying means is represented by B, the weight per unit time of the fine powder introduced to the second classifying means is represented by C, the weight per unit time of the coarse powder collected in the first divided section and fed back to the pulverizing means or first classifying means is represented by G, the weight per unit time of the median powder collected in the second divided section is represented by M and the weight per unit time of the fine powder collected in the third divided section is represented by F, the weights B, C, F, G and M are controlled to satisfy the following expressions:

$0.3 \leqq$ weight B/weight $C \leqq 0.8$, $0.2 \leqq$ weight G/weight $C \leqq 0.7$, and $0.8 \leqq$ weight B/(weight F+weight M) $\leqq 1.2$.

The objects of the present invention can also be achieved by an apparatus system for producing a toner for developing an electrostatic image, comprising;

a first constant-feeding means for constantly feeding a pulverized feed material;

a first control means for controlling the quantity of the pulverized feed material fed from said first constant-feeding means;

a first classifying means for classifying the pulverized feed material fed from said first constant-feeding means, into coarse powder and fine powder;

a pulverizing means for pulverizing the coarse powder classified through said first classifying means;

an introducing means for introducing a powder pulverized through said pulverizing means to said first classifying means;

a multi-division classifying means for classifying the fine powder classified through said first classifying means, into at least coarse powder, median powder and fine powder by the Coanda effect;

a second constant-feeding means for constantly feeding said fine powder classified through said first classifying means, to said multi-division classifying means;

a detecting means for detecting the quantity of the fine powder held in said second constant-feeding means;

a second control means for controlling the quantity of the fine powder fed from said second constant-feeding means;

an introducing means for introducing said fine powder at a high velocity to said multi-division classifying means;

a feeding means for feeding the coarse powder classified through said multi-division classifying means to said pulverizing means or said first classifying means; and a microcomputer for controlling said first control means and said second control means according to information from said detecting means.

DETAILED DESCRIPTION OF THE PREFERRED EMBODIMENTS

The present invention provides a process that can efficiently produce a median powder (a toner powder) having a volume average particle diameter in the range of from 4 μm to 10 μm and a coefficient of variation of number distribution, represented by A, satisfying $20 \leqq A \leqq 45$. The coefficient of variation herein referred to is a value to show a variation from a mean value. The smaller the value is, the sharper the particle size distribution is. The larger the value is, the broader the particle size distribution is. This is a measure that embraces also the extent of a deviation corresponding with particle diameter.

In a pulverizing-classifying method making use of a classifier used only for removing fine particles, coarse particles with a particle size above a prescribed range have been required to be completely removed. For this reason, a pulverizing capacity beyond necessity is required in a pulverizing step, consequently causing excessive pulverization to bring about a lowering of the efficiency of comminution.

This phenomenon becomes remarkable with a decrease in the particle size of a powder. The efficiency greatly decreases particularly when a median powder with a volume average particle diameter of from 4 μm to 10 μm is produced. In jet mills or mechanical mills usually used as pulverizers, their throughput capacity can not help being greatly dropped to obtain fine powder of 10 μm or less.

The process of the present invention enables simultaneous removal of coarse particles and fine particles by a multi-division classifying means. Hence, even if coarse particles with a particle size above a prescribed range are included in a certain proportion in regard to the particle size of the powder at the time of completion of pulverization, they can be well removed in the subsequent multi-division classifying means. This brings about less restrictions in the pulverizing step and the capacity of a pulverizer can be increased to a maximum, so that the efficiency of comminution can be improved to less tend to cause the excessive pulverization.

This also makes it possible to very efficiently remove fine powder and to well improve the classification yield.

Figure 1:
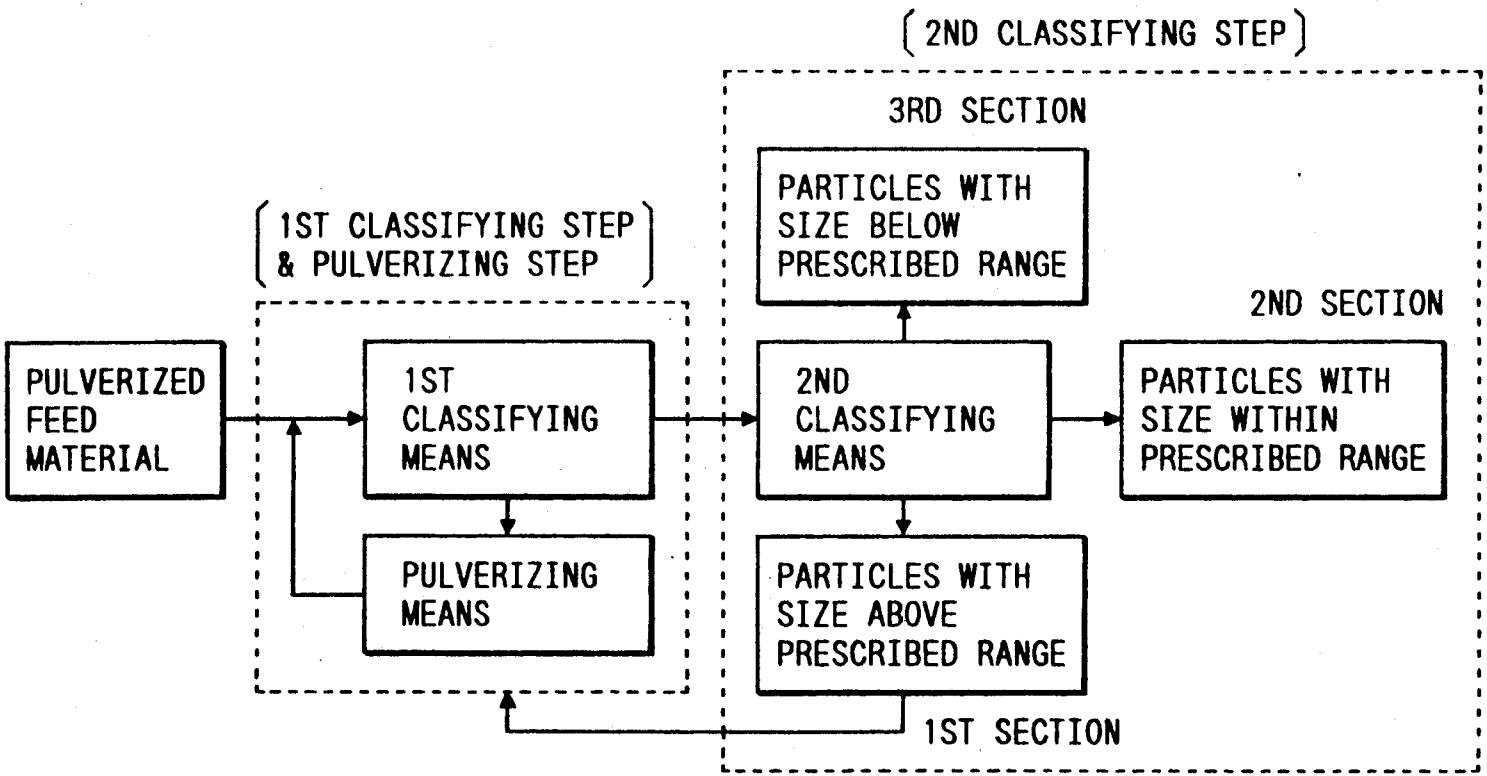
FIG. 1 is a flow chart to describe the production process of the present invention.
Figure 4:
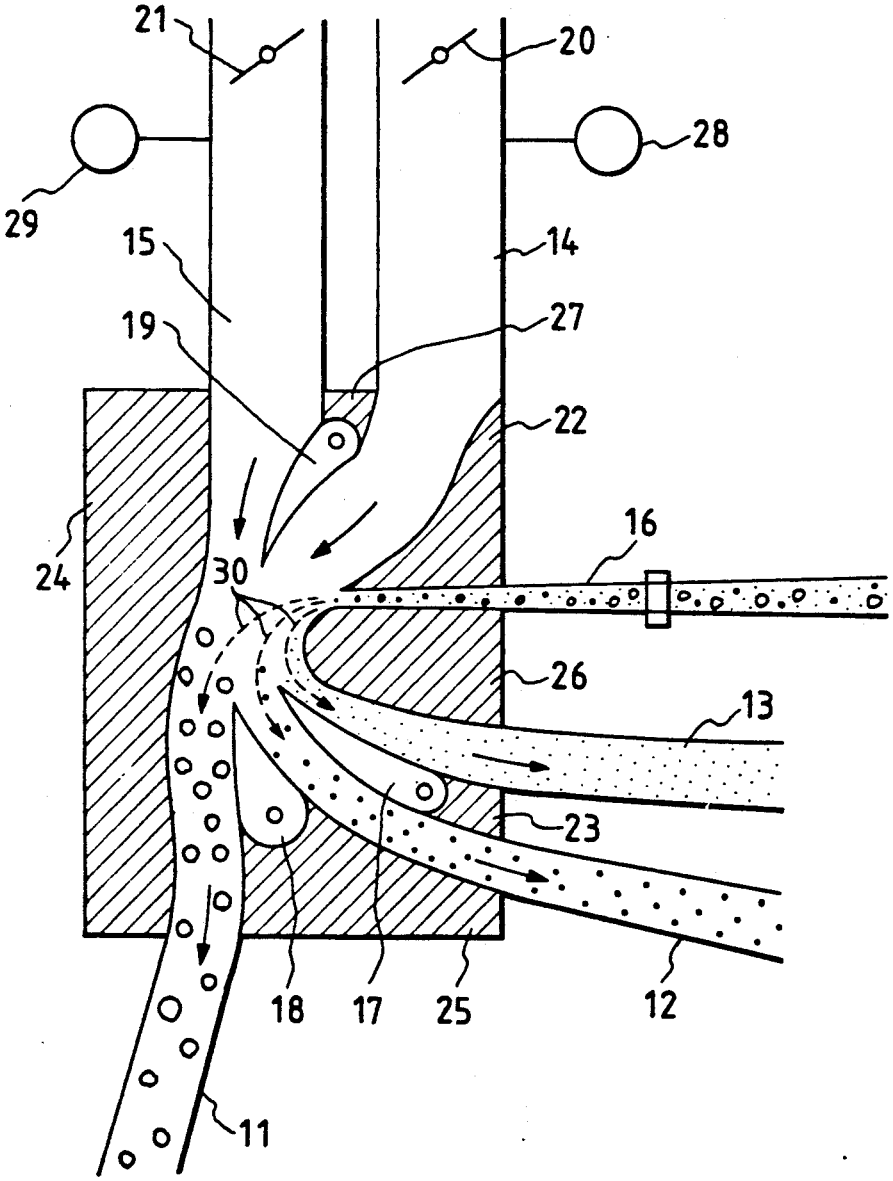
FIGS. 4 and 5 are a cross section and a perspective cross section, respectively, of a classifying apparatus which is an example for working the multi-division classifying means of the present invention.
Figure 5:
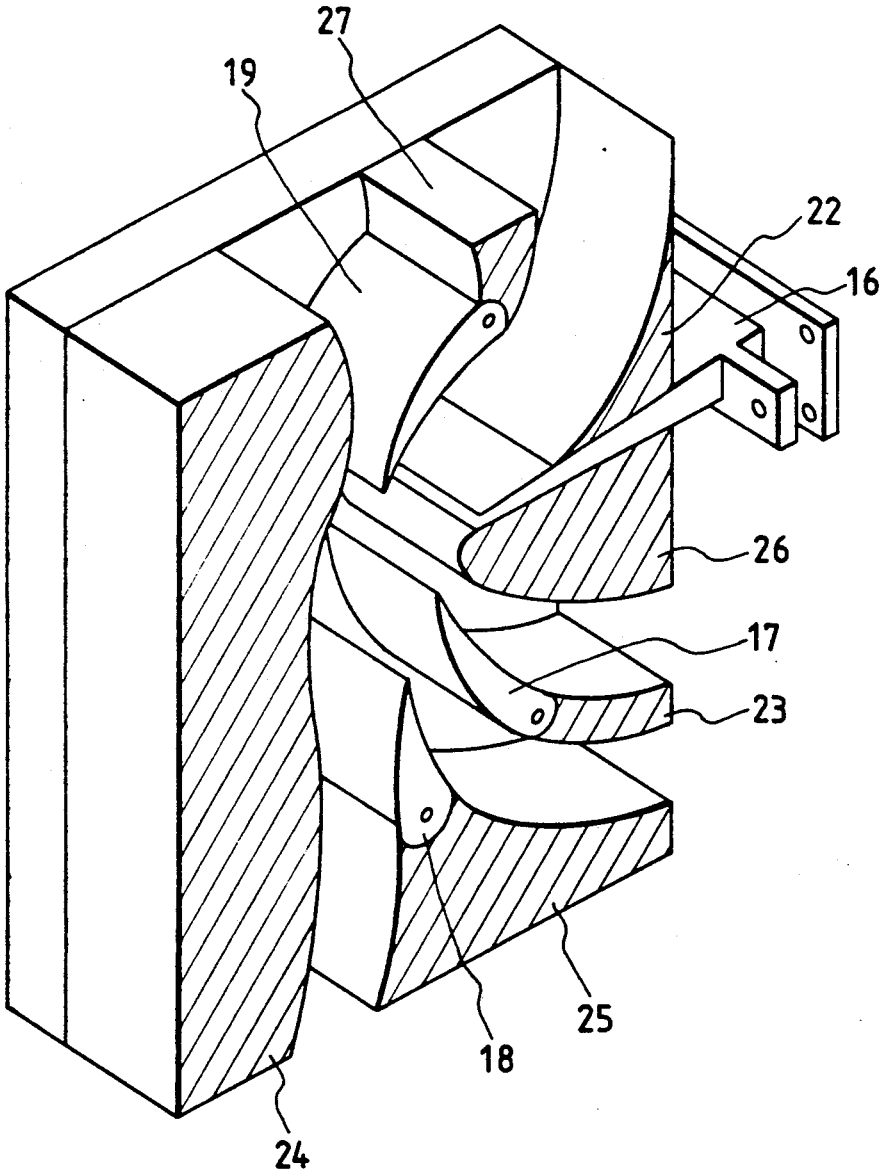

In the present invention, the pulverizing step shown in the flow chart in FIG. 1 is by no means limited thereto. For example, two first classifying means may be provided with respect to one pulverizing means, or two or more means may be provided for each of the pulverizing means and the first classifying means. Any combination in the constitution of the pulverizing step may be suitably set up depending on the desired particle size and the materials for constituting toner particles. In this case, the place at which the coarse powder fed back to the pulverizing step may be suitably set up. A multi-division classifier used as the second classifying means is by no means limited to the form as shown in FIGS. 4 and 5, and those having a most suited form may be employed depending on the particle size of the pulverized feed material, the desired particle diameter of the median powder, and the true specific gravity of powders.

The pulverized feed material fed to the first classifying means should be controlled to be 2 mm or less, and preferably 1 mm or less, in particle diameter. Those obtained by introducing the pulverized feed material to a median pulverizing step to further pulverize it to about 10 to 100 μm may be used as the pulverized feed material in the present invention.

In a conventional classifying system for the classification into median powder and fine powder, aggregates of fine particles that cause fogging of developed images tend to be formed because of a long residence time of particles at the time of classification. Once the aggregates have been formed, it is usually difficult to remove them from the median powder. According to the present invention, however, even if the aggregates have been included into a pulverized product, the aggregates can be disintegrated because of the Coanda effect and/or the impact accompanying high-speed movement, and thus can be removed as fine powder. Even if any aggregates have escaped from being disintegrated they can also be simultaneously driven off to a coarse powder zone. Thus the aggregates can be efficiently removed.

In usual instances, the toner for developing electrostatic images is produced by melt-kneading starting materials such as a binder resin as exemplified by a styrene resin, a styrene-acrylate resin, a styrene-methacrylate resin or a polyester resin, a coloring agent (and/or a magnetic material), an anti-offset agent and a charge-controlling agent, followed by cooling, pulverization and classification. Here, in the kneading step, it is difficult to obtain a molten product in which all the materials have been uniformly dispersed. Hence, particles undesirable as toner particles (e.g., those containing no coloring agent or magnetic material, or particles comprised of each material alone) may be mixed in the pulverized product obtained after pulverization. In a conventional pulverizing and classifying method, the residence time of the particles in the course of pulverization and classification is so long that the undesirable particles tends to aggregate, and it has been difficult to remove the aggregates formed. This has tended to lower toner characteristics.

In the process of the present invention, the pulverized product is instantaneously classified into three portions or more, and hence the aggregates stated above tend to be formed. Even when they have been formed, it is possible to drive them off to a coarse powder zone. Thus a toner product comprised of particles with uniform components and also having a precise particle size distribution can be obtained.

The toner obtained by the process of the present invention can achieve a stable quantity of triboelectricity between toner particles or between the toner and a sleeve or the toner and a carrier. Thus, the development fog or the black spots of toner around edges of latent images may little occur, a high image density can be obtained, and the half-tone reproduction can be improved. It is further possible to maintain initial characteristics and provide high-quality images over a long period of time even when a developer is continuously used over a long period of time. Even when used under conditions of high temperature and high humidity, the quantity of triboelectricity of the developer can be stable because of less presence of ultrafine particles and aggregates thereof and may little change compared with the case of normal temperature and normal humidity, so that development faithful to latent images can be carried out with less fog and decrease in image density. Moreover, the toner image obtained can be transferred to a transfer medium such as paper in a superior transfer efficiency. Even when used under low temperature and low humidity, the distribution of the quantity of triboelectricity little changes compared with the case of normal temperature and normal humidity. Since the ultrafine particle component having a very large quantity of triboelectricity has been removed, neither decrease in image density nor fog may occur, and also coarse images and black spots around images at the time of transfer may little occur. The toner obtained by the process of the present invention has such advantageous features.

The particle size distribution of toners can be measured by various methods. In the present invention, it is measured using a Coulter counter.

A coulter counter Type-II (manufactured by Coulter Electronics, Inc.) is used as a measuring device. An interface (manufactured by Nikkaki) that outputs number distribution and volume distribution and a personal computer CX-I (manufactured by Canon Inc.) are connected. As an electrolytic solution, an aqueous 1% NaCl solution is prepared using first-grade sodium chloride. Measurement is carried out by adding as a dispersant 0.1 ml to 5 ml of a surface active agent (preferably an alkylbenzene sulfonate) to 100 ml to 150 ml of the above aqueous electrolytic solution, and further adding 2 mg to 20 mg of a sample to be measured. The electrolytic solution in which the sample has been suspended is subjected to dispersion for 1 minute to 3 minutes in an ultrasonic dispersion machine. The particle size distribution of particles of 2μ to 40μ is measured on the basis of the number of means of the above Coulter counter Type TA-II, using an aperture of 100μ as its aperture, and then the volume average particle diameter and coefficient of variation are determined.

The present invention will be specifically described with reference to the accompanying drawings.

FIG. 1 is a flow chart to show the outline of the production process of the present invention. In the present invention, the pulverized feed material in a given quantity is introduced to the first classifying means, and classified into coarse powder and fine powder in the first classifying means. The coarse powder is fed to a pulverizing means, pulverized there and, after the pulverization, introduced to the first classifying means. The fine powder in a given quantity is fed to the second classifying means, and classified into at least fine powder, median powder and coarse powder. The coarse powder in a given quantity is introduced to the pulverizing means or the first classifying means. The median powder thus classified is used as the toner as it is, or used as the toner after it has been incorporated with additives such as hydrophobic colloidal silica. The classified fine powder is usually fed back for its reuse, to the melt-kneading step for producing the pulverized feed material, or discarded.

In the production process of the present invention, the controlling of the conditions for classification and pulverization makes it possible to efficiently produce a toner with a small particle size, having an volume average particle diameter of from 4 μm to 10 μm (preferably from 4 μm to 9 μm) and a coefficient of variation of number distribution, represented by A, ranging from 20 to 45.

In carrying out the process of the present invention, various studies have been made to reveal that the relationship between the weight B per unit time of the pulverized feed material fed to the first classifying means, the weight C per unit time of the fine powder introduced to the second classifying means, the weight G per unit time of the coarse powder collected in the first divided section and fed back to the pulverizing means or the first classifying means, the weight M per unit time of the median powder collected in the second divided section and the weight F per unit time of the fine powder collected in the third divided section is a factor very important to efficient production of toner particles having a small particle size.

An improvement in efficiency of the productivity of the median powder was well achievable when the weight B and weight C, the weight C and weight G, and the weight B, weight F and weight M satisfied the following expressions, respectively:

$0.3 \leqq \text{weight B/weight C} \leqq 0.8$, $0.2 \leqq \text{weight G/weight C} \leqq 0.7$, and $0.8 \leqq \text{weight B/(weight F+weight M)} \leqq 1.2$.

In order to efficiently obtain the median powder with a small particle size, it is important to control the quantity of the coarse powder being classified in the second classifying means. This is based on the following: An excessively large quantity of the coarse powder being classified in the second classifying means brings about an increase in the quantity of the powder fed back to the pulverizing means, resulting in an increase in the load in the pulverizing means. An excessively small quantity of the coarse powder makes it necessary to more severly control the quantity of the coarse powder in the pulverizing step, resulting in a decrease in the throughput in the pulverizing means. Under such circumstances, intensive studies were made in order to find the way to carry out this classification in a best efficiency. As a result, an improvement in the efficiency of comminution for the coarse powder in the pulverizing means and the coarse powder fed back to the pulverizing means from the second classifying means and in improvement in the classification efficiency for the median powder in the second classifying means were achievable when the weight C and weight G satisfy $0.2 \leqq \text{weight G/weight C} \leqq 0.7$.

In the case when such an integrated system for pulverization and classification is constructed, it is important to balance the weight B per unit time of the pulverized feed material fed to the first classifying means, the weight M per unit time of the median powder taken out of the system as an end product, and the weight F per unit time of the fine powder collected in the third divided section. In order to carry out the process of the present invention, it is necessary in view of stable production to carry out the process in the manner that the weight B and weight C, and the weight B, weight F and weight M satisfy the following expressions, respectively:

$0.3 \leqq \text{weight B/weight C} \leqq 0.8$, $0.8 \leqq \text{weight B/(weight F+weight M)} \leqq 1.2$.

In actually producing a toner powder by the process of the present invention, the weight B and weight C may be so determined that the above relationship can be satisfied, according to the quantity of the coarse powder being classified in the second classifying means. By doing so, the balance of the pulverizing step and classification steps as shown in the flow chart in FIG. 1 can be improved, so that the efficiency in the pulverizing step and classification step can be improved and also the stable production becomes feasible. Stated specifically, this brings about an increase in the quantity of the median powder finally obtained. relative to the pulverized feed material initially fed (i.e., an increase in classification yield).

In the present invention, the pulverizing step shown in the flow chart in FIG. 1 is by no means limited thereto. For example, two first classifying means may be provided with respect to one pulverizing means, or two or more means may be provided for each of the pulverizing means and the first classifying means. Any combination in the constitution of the pulverizing step may be suitably set up depending on the desired particle size and materials. In this case, the place at which the coarse powder fed back to the pulverizing step may be suitably set up.

Figure 2:
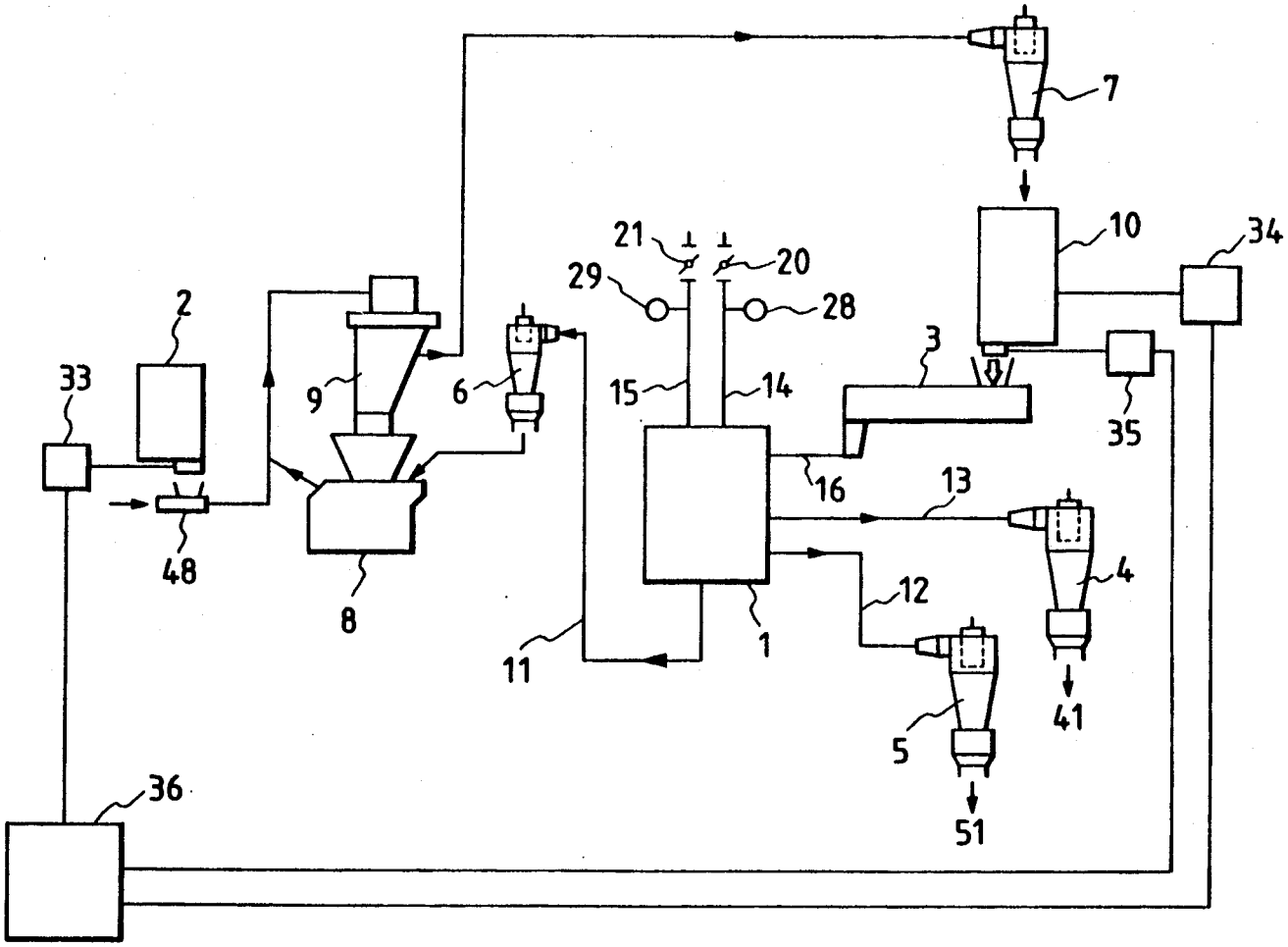
FIGS. 2 and 3 each schematically illustrate an apparatus system for carrying out the production process of the present invention.

The apparatus system shown in FIG. 2 comprises a first constant feeder 2 for feeding the pulverized feed material in a given quantity, a first control means 33 for controlling the on-off and/or operational standing of the first constant feeder 2, an air conveyor means 48 for conveying the pulverized feed material, a first classifier 9 for classifying the pulverized feed material, a collecting cyclone 7 for collecting classified fine powder, a second constant feeder 10, a detecting means 34 for detecting the quantity of the fine powder stored in the second constant feeder 10, a second control means 35 for controlling the on-off and/or operational standing of the second constant feeder 01, a vibrating feeder 3, a multi-division classifier 1, a collecting cyclone 4 for collecting the fine powder classified through the multi-division classifier 1, a collecting cyclone 5 for collecting the median powder classified through the multi-division classifier 1, a collecting cyclone 6 for collecting the coarse powder classified through the multi-division classifier 1, and a microcomputer for controlling the first control means 33 and the second control means 35 according to information from the detecting means 34.

In this apparatus system, a toner powder material serving as the pulverized feed material is led into the first classifier 9 through the first constant feeder 2. The classified fine powder is fed into the second constant feeder 10 through the collecting cyclone 7, and then led into the multi-division classifier 1 through the vibrating feeder 3 and a fine powder feed nozzle 16. The coarse powder classified in the first classifier 9 is fed into the pulverizer 8, pulverized there and thereafter led again into the first classifier 9 together with a pulverized feed material newly fed.

In the first classifier 9, an air current classifier is used, including, for example, DS Type Classifier, manufactured by Nippon Pneumatic Kogyo K.K., and Micron Separator, manufactured by Hosokawa Micron Corporation.

Figure 7:
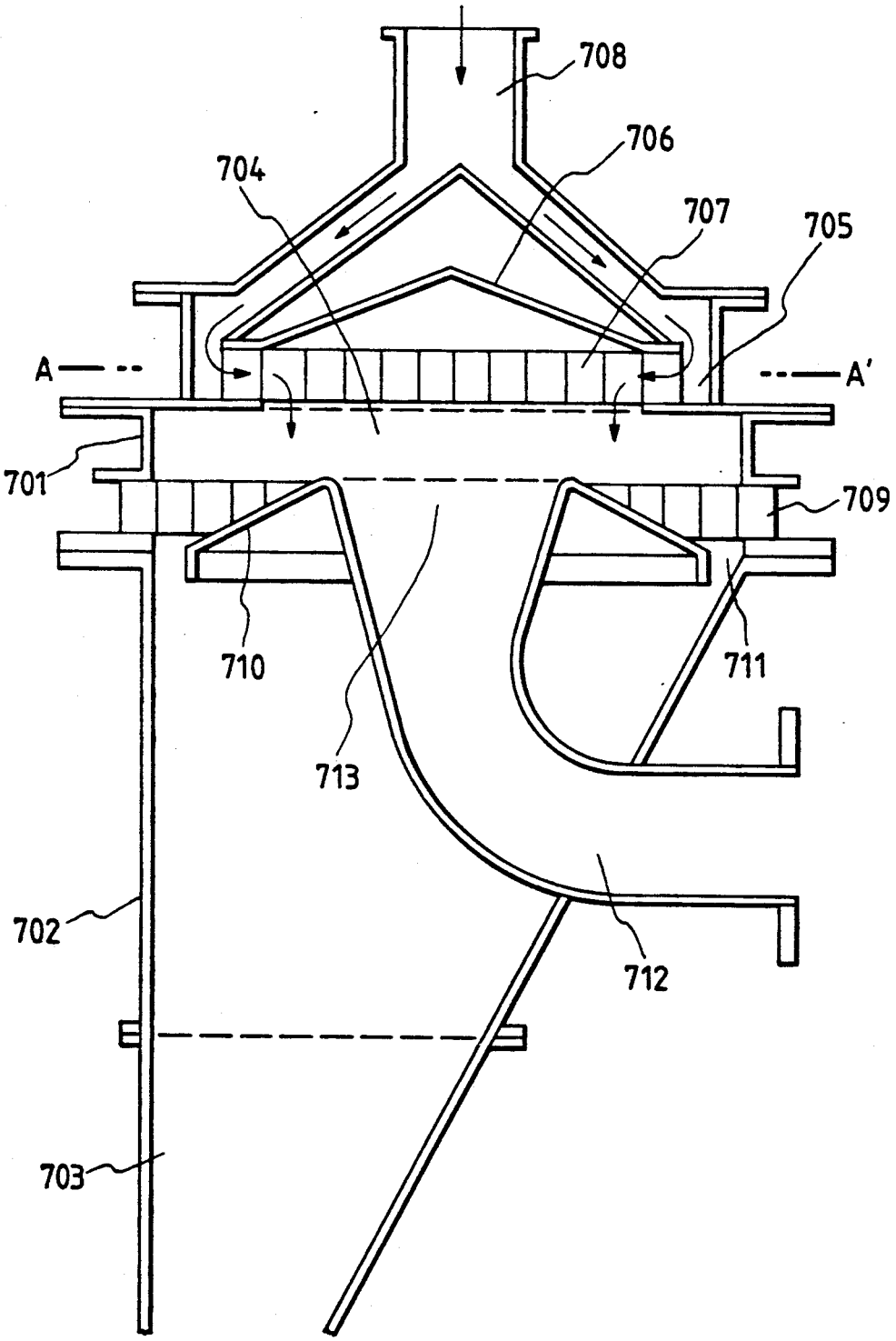
FIG. 7 is a schematic cross section of a preferred example of the first classifying means used it the production process and apparatus system of the present invention.
Figure 8:
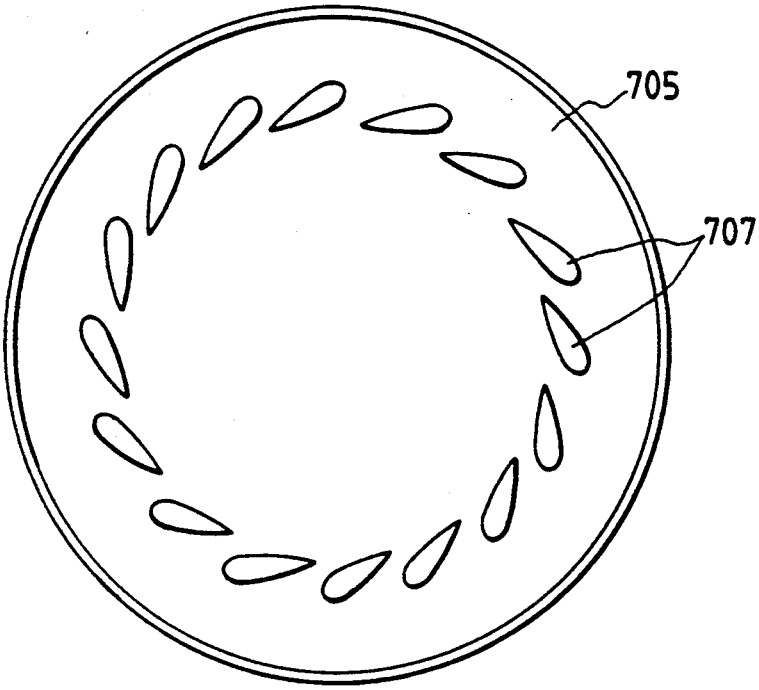
FIG. 8 is a cross section along the line A-A' in FIG. 7.

In order to improve the accuracy of classification into the fine powder and the coarse powder, it is preferred to use the air current classifier as shown in FIGS. 7 and 8.

In FIG. 7, the numeral 701 denotes a main body casing; and 702, a lower part casing, to which a coarse powder discharge hopper 703 is connected at its lower part. A classifying chamber 704 is formed inside the main body casing 701, and the upper part of this classifying chamber 704 is closed by a circular guide chamber 705 mounted on the top of the main body casing 701 and by a conical (or umbrella) top cover 706 raised at its central part.

A plurality of louvers 707 arranged in the circumferential direction are provided on a partition wall between the classifying chamber 704 and the guide chamber 705, where the pulverized feed material and air fed into the guide chamber 705 are whirlingly flowed into the classifying chamber 704 from the openings between the respective louvers 707.

At the lower part of the main body casing 701, classifying louvers 709 arranged in the circumferential direction are provided, from which classifying air for producing a whirling stream is taken into the classifying chamber 704 from the outside through the classifying louvers 709.

A conical (or umbrella) classifying plate 710 raised at the central part is provided at the bottom of the classifying chamber 704, and a coarse powder discharge opening 711 is formed on the periphery of said classifying plate 710. A fine powder discharge chute 712 having a fine powder discharge outlet 713 is connected to the central part of the classifying plate 710, and a lower end of the chute 712 is bent in the shape of an L. An end portion of this bend is made to be at the position external to the side wall of the lower part casing 702. This chute is further connected to a section fan through a fine powder collecting means such as a cyclone or dust collector, where a suction force is acted in the classifying chamber 704 by the operation of the suction fan, and the whirling stream necessary for the classification is produced by the suction air flowed into the classifying chamber 704 from the openings between the louvers 709.

air current classifier preferably used as the first classifying means is constructed as described above. The feed material pulverized using an impact air pulverizer, the air having been used in pulverization and the air containing a powder material comprised of a pulverized feed material newly fed are fed into the guide chamber 705 from the feed cylinder 708, so that the air containing this powder material is flowed from the guide chamber 705 through the openings between the louvers 707 into the classifying chamber 704 while whirling and while being dispersed in a uniform density.

The powder material flowed into the classifying chamber 704 while whirling is forced to whirl in an increasing velocity by being carried on the suction air flowed in from the openings between the classifying louvers 709 at the bottom of the classifying chamber 704, by the operation of the suction fan connected to the fine powder discharge chute 712 through a collecting cyclone, and centrifugally separated into fine powder and coarse powder by the centrifugal force acting on the particles. The coarse powder that whirls around the periphery inside the classifying chamber 704 is discharged form the coarse powder discharge opening 711, and discharged from the hopper 703 at the lower part.

The fine powder that moves to the central part along the upper inclined surface of the classifying plate 701 is discharged to a fine powder collecting means such as a collecting cyclone through the fine powder discharge chute 712.

The air flowed into the classifying chamber 704 together with the powder material is flowed in the form of a whirling stream, and hence the velocity toward the center, of the particles that whirl inside the classifying chamber 704, becomes relatively small as compared with the centrifugal force and the classification for separated particles with a smaller size is well achieved in the classifying chamber 704, so that the fine particles having a small particle size can be discharged to the fine powder discharge chute 712. Moreover, since the powder material is flowed into the classifying chamber in substantially uniform density, the powder can be obtained with a precise distribution.

As the pulverizer 8, a pulverizing means such as an impact mill and a jet mill can be used. The impact mill may include a turbo-mill manufactured by Turbo Kogyo K.K. The jet mill may include an ultrasonic jet mill PJM-I, manufactured by Nippon Pneumatic Kogyo K.K., and Micron Jet, manufactured by Hosokawa Micron Corporation.

Figure 9:
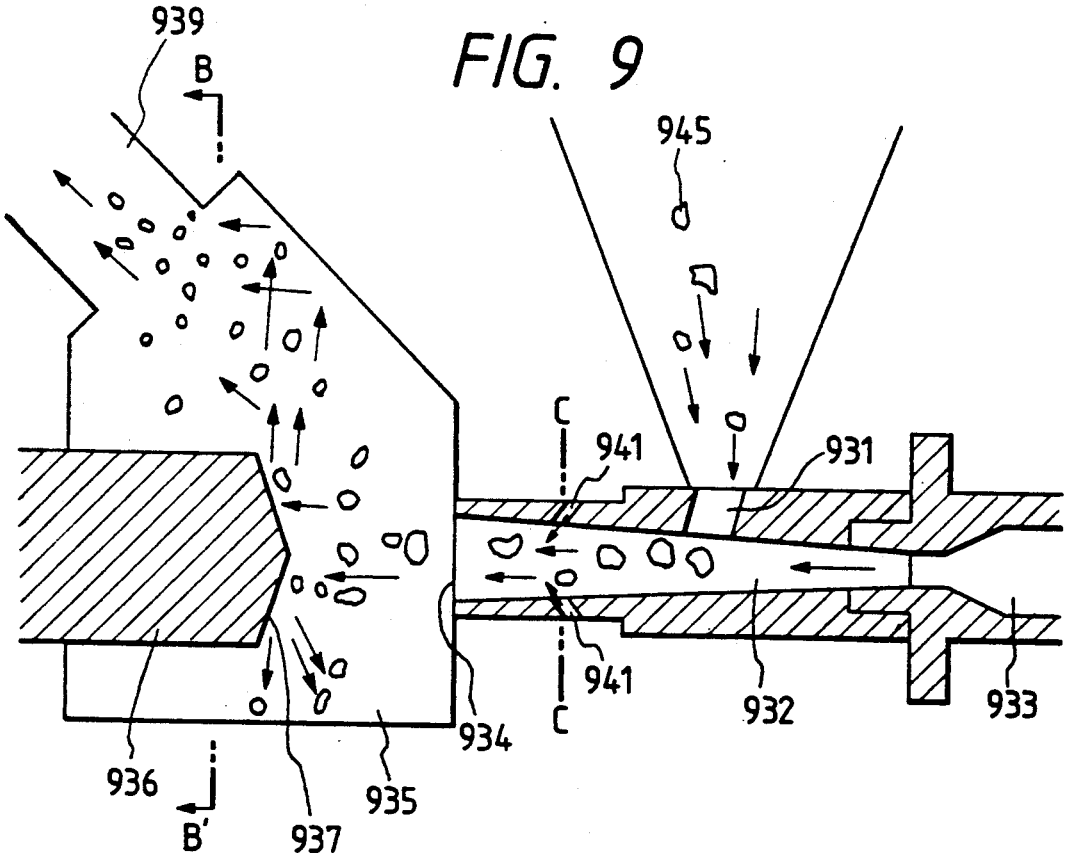
FIG. 9 is a schematic cross section of a preferred example of an impact mill used in the production process and apparatus system of the present invention.
Figure 10:
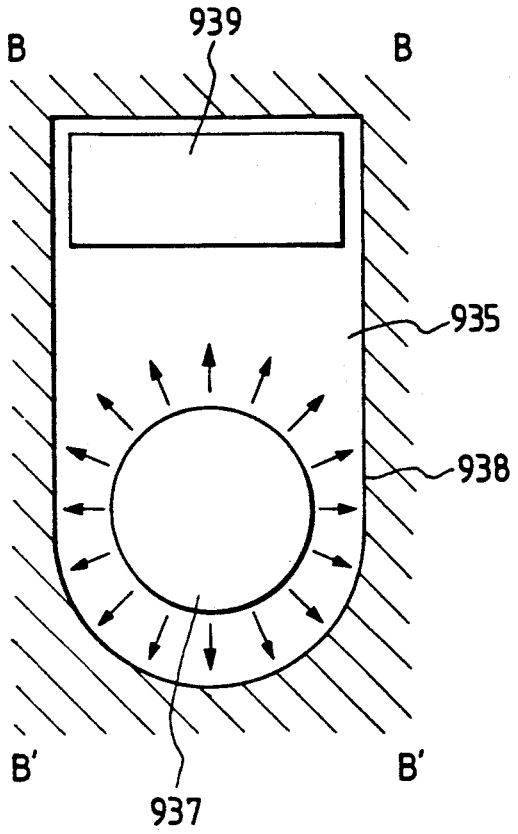
FIGS. 10 and 11 are a cross section along the line B-B' in FIG. 9 and a cross section along the line C-C' in FIG. 9, respectively.

In view of efficiency of comminution and in order to prevent aggregation of powder in the pulverizer, it is preferred to use the impact pneumatic pulverizer as shown in FIGS. 9 and 10.

The impact pneumatic pulverizer is, as shown in FIG. 9, equipped with an accelerating tube 932 for acceleratingly conveying a powder by the action of a high-pressure gas fed from a feed nozzle 933, a pulverizing chamber 935 and an impact member 936 against which the powder jetted form the accelerating tube collides and by the force of which the powder is pulverized. The impact member is provided opposingly to an accelerating tube outlet 934. In particular, in view of efficiency of comminution and in order to prevent secondary aggregation from occurring in the pulverizer, it is preferred to use an impact pneumatic pulverizer in which the front end of an impact surface 937 of the impact member 936 has a conical shape having a vertical angle of from 110° to less than 180°, preferably from 110° C. to 175° C., and more preferably from 120° to 170° C. It is more preferred to use an impact pneumatic pulverizer in which a feed opening 931 for a pulverizing material 945 is provided on the above accelerating tube and a secondary air inlet 941 is provided between the pulverizing material feed inlet and the accelerating tube outlet. It is effective to carry out pulverization under the introduction of secondary air.

After the pulverizing material collides against the impact surface, the pulverized product is scattered in the peripheral direction as shown in FIG. 10, discharged from an discharge outlet 939, and then sent to the first classifying means.

The powder to be classified may preferably have a true specific gravity of from about 0.5 to 2.0, and more preferably from 0.6 to 1.8, in view of the classification efficiency. As a means for providing the multi-division classification zone corresponding to the second classifying means, a multi-division classifier of the system as illustrated in FIG. 4 (a cross section) and FIG. 5 (a stereoscopic view) can be exemplified as an embodiment. In FIGS. 4 and 5, side walls have the shapes as indicated by the numerals 22 and 24 and a lower wall has the shape as indicated by the numeral 25, where the side wall 23 and the lower wall 25 are provide with knife edge-shaped classifying wedges 17 and 18, respectively, and these classifying wedges 17 and 18 divide the classifying zone into three sections. A material (the fine powder classified through the first classifying means) feed nozzle 16 opening into the classifying chamber is provided at the lower part of the side wall 22. A coanda block 26 is disposed along an extension of the lower tangential line of the nozzle 16 so as to form a long elliptic arc that curves downward. The classifying chamber has an upper wall 27 provided with a knife edge-shaped air-intake wedge 19 extending downward, and further provided above the classifying chamber with air-intake pipes 14 and 15 opening into the classifying chamber. The air-intake pipes 14 and 15 are respectively provided with a first gas feed control means 20 and a second gas feed control means 21, respectively, comprising, e.g. a damper, and also provided with static pressure gauges 28 and 29. The locations of the classifying wedges 17 and 18 and the air-intake wedge 19 may vary depending on the kind of the fine powder, and also the desired particle size. At the bottom of the classifying chamber, discharge pipes 11, 12 and 13 opening into the chamber are provided corresponding to the respective divided sections. The discharge pipes 11, 12 and 13 may be respectively provided with shutter means such as valve means.

The weight F, weight G and weight M can be controlled by controlling the quantity of the fine powder fed from the fine powder feed nozzle 16, the angles of the classifying wedges 17 and 18, the angle of the air-intake wedge 19 and the control means 20 and 21.

The fine powder feed nozzle 16 comprises a flat rectangular pipe section and a tapered rectangular pipe section, and the ratio of the inner diameter of the flat rectangular pipe section to the inner diameter of the inner diameter of the narrowest part of the tapered rectangular pipe section may be set to from 20:1 to 1:1 to obtain a good feed velocity.

The classification in the multi-division classifying zone having the above construction is operated, for example, in the following way. The inside of the classifying chamber is evacuated through at least one of the discharge pipes 11, 12 and 13. The fine powder is fed at a high velocity to the classifying zone through the fine powder feed nozzle 16 opening into the classifying zone, at a flow velocity of from 50 m/sec to 300 m/sec utilizing a gas stream flowing as a result of the evacuation.

Feeding the fine powder to the classifying zone at a flow velocity of less than 50 m/sec makes it difficult to well disintegrate the aggregation of the aggregates present in the fine powder, thus tending to cause a lowering of the classification yield and accuracy of classification. Feeding the fine powder to the classifying zone at a flow velocity of more than 300 m/sec may result in collision between particles to tend to cause the size reduction of particles to tend to newly produce fine particles, thus tending to lower the classification yield.

The fine powder thus fed is moved with a curve 30 by the action attributable to the Coanda effect of the Coanda block 26 and the action of gases such as the air concurrently flowed in, and classified corresponding to the particle size and weight of the respective particles. If the particles in the fine powder have the same specific gravity, larger particle powder (coarse powder) is classified to the outside of air current (i.e., the first divided section at the left side of the classifying wedge 18), median powder (particles having a particle size within the prescribed range) is classified to the second divided section defined between the classifying wedges 18 and 17, and fine powder (particles having a particle size below the prescribed range) is classified to the third divided section at the right side of the classifying wedge 17. The coarse powder thus classified is discharged from the discharge pipe 11, the median powder is discharged from the discharge pipe 12, and the fine powder is discharged form the discharge pipe 13, respectively.

Figure 3:
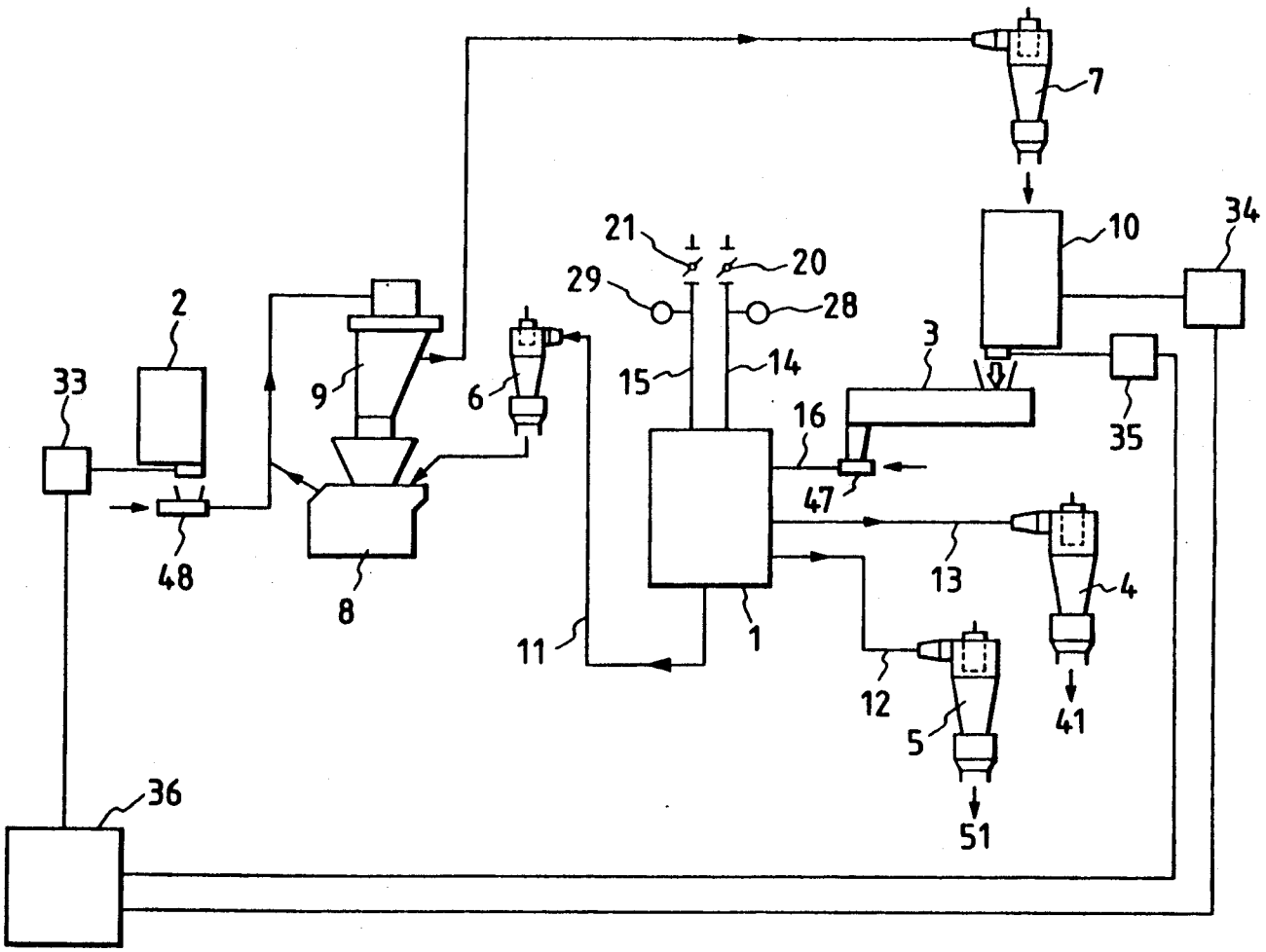

The fine powder can be fed into the classification zone by a method in which the powder is fed into it by suction utilizing a suction force of a cyclone, a method in which a fine powder feed nozzle is provided with an air conveyor means such as an injector so that the powder can be fed into it by the action of compressed air fed from the injector, or the pressure feeding means. The suction feeding or the feeding method in which the air conveyor means such as an injector is preferred since it less requires to seal the apparatus system than the pressure feeding method. FIG. 3 shows an example of the apparatus system in which an injector 47 is fitted to the part of the fine powder feed nozzle.

The second classifier multi-division classifier may include a classifying means that utilizes the Coanda effect, having the Coanda block, as exemplified by Elbow Jet, available from Nittetsu Kogyo K.K.

the classifying zone of the multi-division classifier 1 is constructed usually with a size of [10 to 50 cm]×[10 to 50 cm], and hence the fine powder can be instantaneously classified in 0.1 to 0.01 second, into three or more groups of particles. In the case when the multi-division classifier 1 is divided into three sections, the fine powder classified through the first classifying means is divided into coarse powder (particles having a particle size above the prescribed range), median powder (particles having a particle size within the prescribed range) and fine powder (particles having a particle size below the prescribed range). Thereafter, the coarse powder is passed through the discharge pipe 11 and fed back to the pulverizer 8 through the collecting cyclone 6.

The coarse powder may be fed back to the first classifier 9 or the first constant feeder 2. In order to more surely carry out pulverization using the pulverizer 8, it is more preferred for the coarse powder to be directly fed back to the pulverizer 8.

The median powder is discharged outside the system through the discharge pipe 12, and collected in the collecting cyclone 5 so that it can be used as a toner product 51. The fine powder is discharged outside the system through the discharge pipe 13, collected in the collecting cyclone 4, and then recovered as a minute particle powder 41 having a particle size outside the prescribed range. The collecting cyclones 4, 5 and 6 also function as suction evacuation means for suction-feeding the fine powder to the classifying zone through the nozzle 16.

The weight B per unit time can be controlled by mainly controlling the quantity in which the pulverized feed material is fed from the first constant feeder 2, the conditions for the classification into fine powder and coarse powder in the first classifier 9 and the weight G of the coarse powder fed from the multi-division classifier 1.

The weight C per unit time can be controlled by mainly controlling the weight B and the quantity of the fine powder and coarse powder classified in the first classifier 9.

The weight F, weight G and weight M per unit time can be controlled by mainly controlling the conditions for the classification in the multi-division classifier 1 and the feed quantity of the fine powder fed from the second constant feeder 10.

In the present invention, in order to well control the quantities of the powders in the classifying-pulverizing apparatus system and also well keep the mutual relations between the weight B, weight C, weight F, weight G and weight M within the prescribed condition, the apparatus system may preferably have the first control means 33 that operates or stops the first constant feeder 2 to control the weight B per unit time. The first control means 33 may have a control function that controls the operational standing of the first constant feeder 2 to directly vary the weight B per unit time. The second constant feeder 10 may also preferably be equipped with the detecting means 34 such as a level detecting means for detecting the quantity of the fine powder held therein, and also equipped with the second control means 35 for controlling the operational standing of the second constant feeder 10. The apparatus system may preferably be further equipped with the microcomputer 36 that forwards control signals to the first control means 33 and second control means 35 according to information from the detecting means 34.

Thus it becomes possible for the weight balance of the powders in all the sections to be constantly well kept within the prescribed range.

The present invention will be described below in greater detail by giving Examples.

The data given in Examples and Comparative Examples in relation to the particle size distribution were obtained by measurement with the Coulter counter previously described. In the following, "part(s)" refers to "part(s) by weight".

EXAMPLE 1

| | |
|---|---|
| Styrene/butyl acrylate/divinylbenzene copolymer (polymerized monomer weight ratio: 80.0/19.0/1.0; Mw (weight average molecular weight): 350,000) | 100 parts |
| Magnetic iron oxide (average particle diameter: 0.18 μm | 100 parts |
| Nigrosine | 2 parts |
| Low-molecular ethylene/propylene copolymer | 4 parts |

The above materials were throughly mixed using a blender, and thereafter kneaded using a twin-screw kneading extruder set to 150° c. The resulting kneaded product was cooled and then pulverized to have a particle diameter of 1 mm or less. A pulverized feed material was thus obtained.

The pulverized feed material thus obtained was pulverized and classified using the pulverizing-classifying system a shown in FIG. 2.

The pulverized feed material was put into the constant feeder 2, and fed into the first classifier 9 (an air current classifier DS-10UR, manufactured by Nippon Pneumatic Kogyo K.K.) in a weight B of 40 kg per hour. The classified coarse powder was pulverized in a jet mill, the pulverizer 8, (an ultrasonic jet mill PJM-I-10; manufactured by Nippon Pneumatic Kogyo K.K.), and, after pulverized, fed back to the first classifier. The particle size distribution of the fine powder obtained by classification in the first classifier was measured to find that the fine powder had a volume average diameter of 9.0 μm. The resulting fine powder was put into the constant feeder 10, and then fed into the multi-division classifier 1 as illustrated in FIGS. 4 and 5, through the vibrating feeder 3 and the nozzle 16 in a weight C of 80 kg per hour so as to be classified into three kind of the coarse powder, median powder and fine powder by utilizing the Coanda effect. As the multi-division classifier 1, Elbow Jet EJ-30-3 (manufactured by Nittetsu Kogyo K.K.) was used.

In feeding the fine powder, the collecting cyclones 4, 5 and 6 communicating with the discharge pipes 11, 12 and 13 were operated to evacuate the inside of the system as a result of the suction evacuation, thereby producing a suction force, by the action of which the fine powder was fed to the feed nozzle 16. The fine powder thus fed was instantaneously classified in 0.01 second or less. The classified coarse powder was collected in the collecting cyclone 6 and thereafter fed again into the pulverizer 8.

The weight G of the classified coarse powder was measured in a steady state in the present system to find that it was 40 kg per hour. The classified median powder had a volume average particle diameter of 6.7 μm and a coefficient of variation A of 31.4, and was preferably usable as a toner. The median powder was obtained at a rate of 34 kg (weight M) per hour. The classified fine powder was obtained at a rate of 6 kg (weight F) per hour. The weights B, C, F, G and M showed the following relationship:

$B/C=0.5$ $G/C=0.5$ $B/(F+M)=1.0$

Here, the proportion of the median powder obtained as an end product to the total weight of the pulverized feed material fed (i.e., classification yield) was 85%. The resulting median powder was observed with a microscope to confirm that there was seen substantially no aggregate of about 4 ∝m or more resulting from the aggregation of ultrafine particles.

EXAMPLE 2

A pulverized feed material was obtained in the same manner as in Example 1 except that a starting material magnetic iron oxide was used in an amount of 80 parts, and then classified using the pulverizing-classifying system as shown in FIG. 2.

The weight B per unit time, of the pulverized feed material fed into the first classifying means was set to 50 kg. The classified fine powder in the first classifier had a volume average particle diameter of 10.0 μm.

The weight C per unit time, of the fine powder fed into the second classifying means was 83 kg. The weight G per unit time, of the classified coarse powder was 33 kg.

The classified median powder had a volume average particle diameter of 8.2 μm and a coefficient of variation A of 34.1, and was preferably usable as a toner. The median powder was obtained at a rate of 44 kg (weight M) per hour. The classified fine powder was obtained at a rate of 6.0 kg (weight F) per hour. The weights B, C, F, G and M showed the following relationship:

$B/C=0.6$ $G/C=0.4$ $B/(F+M)=1.0$

Here, the proportion of the median powder obtained as an end product to the total weight of the pulverized feed material fed was 88%. The resulting median powder was observed with a microscope to confirm that there was seen substantially no aggregate of about 4 μm or more resulting from the aggregation of ultrafine particles.

EXAMPLE 3

A pulverized feed material obtained in the same manner as in Example 1 was classified using the pulverizing-classifying system as shown in FIG. 3.

The weight B per unit time, of the pulverized feed material fed into the first classifying means was set to 30 kg. The classified fine powder in the first classifier had a volume average particle diameter of 7.0 μm.

the weight C per unit time, of the fine powder fed into the second classifying means was 75 kg. The weight G per unit time, of the classified coarse powder was 45 kg.

In feeding the fine powder, the collecting cyclones 4, 5 and 6 communicating with the discharge pipes 11, 12 and 13 were operated to evacuate the inside of the system as a result of the suction evacuation, thereby producing a suction force. This suction force and compressed air from the injector fitted to the material feed nozzle were utilized.

The classified median powder had a volume average particle diameter of 5.4 μm and a coefficient of variation A of 27.0, and was preferably usable as a toner. The median powder was obtained at a rate of 24 kg (weight M) per hour. The classified fine powder was obtained at a rate of 6.0 kg (weight F) per hour. The weights B, C, F, G and M showed the following relationship:

$B/C=0.4$ $G/C=0.6$ $B/(F+M)=1.0$

Here, the proportion of the weight of the median powder obtained as an end product to the total weight of the pulverized feed material fed was 80%.

COMPARATIVE EXAMPLE 1

Figure 6:
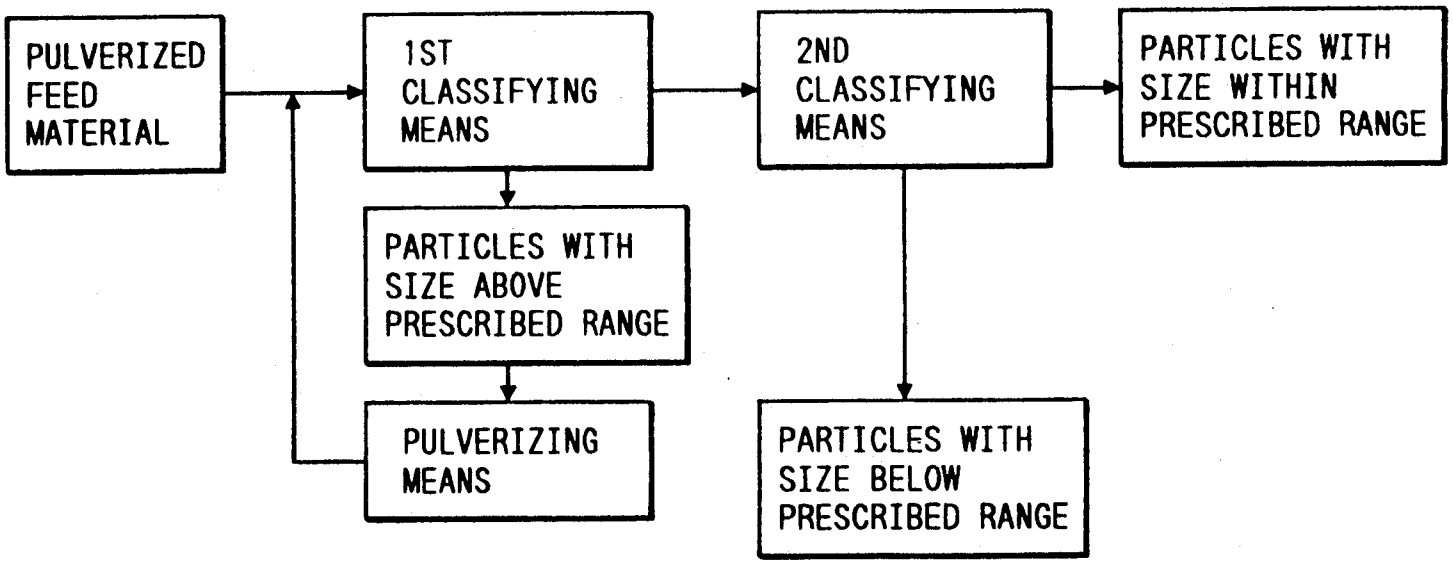
FIG. 6 PRIOR ART
FIG. 6 is a flow chart to describe a conventional production process.

A pulverized feed material obtained in the same manner as in Example 1 was classified using the classifying-pulverizing system as shown in FIG. 6.

The pulverized feed material was fed into the first classifier (an air current classifier DS-10UR, manufactured by Nippon Pneumatic Kogyo K.K.) in a weight of 24 kg per hour. The classified coarse powder was pulverized in a pulverizer (an ultrasonic jet mill PJM-I-10; manufactured by Nippon Pneumatic Kogyo K.K.), and, after pulverized, fed back to the first classifier. The particle size distribution of the fine powder obtained by classification in the first classifier was measured to find that the fine powder had a volume average diameter of 6.3 μm.

The resulting fine powder was fed into the second classifier (an air current classifier DS-5UR, manufactured by Nippon Pneumatic Kogyo K.K.) and classified into median powder and fine powder. The resulting median powder had a particle size distribution of a volume average particle diameter of 6.8 μm and a coefficient of variation A of 34.4, which was collected at a rate of 14.4 kg per hour. The resulting fine powder was obtained at a rate of 9.6 kg per hour. The classification yield was 60%.

Compared with Example 1, the resulting median powder had a broader particle size distribution and was obtained in a smaller quantity, showing that its productivity was inferior.

COMPARATIVE EXAMPLE 2

A pulverized feed material obtained in the same manner as in Example 2 was classified using the classifying-pulverizing system as shown in FIG. 6.

The pulverized feed material fed into the first classifier was in a weight of 30 kg per unit time. The fine powder obtained by classification in the first classifier had a volume average diameter of 7.5 μm.

The resulting fine powder was fed into the second classifier (DS-5UR) and classified into median powder and fine powder. The resulting median powder had a particle size distribution of a volume average particle diameter of 8.1 μm and a coefficient of variation A of 39.4, which was collected at a rate of 20 kg per hour. The fine powder was obtained at a rate of 10 kg per hour. The classification yield was 67%.

Compared with Example 2, the resulting median powder had a broader particle size distribution and was obtained in a smaller quantity, showing that its productivity was inferior.

COMPARATIVE EXAMPLE 3

A pulverized feed material obtained in the same manner as in Example 3 was classified using the classifying-pulverizing system as shown in FIG. 6.

The pulverized feed material was fed into the first classifier (an air current classifier DS-10UR, manufactured by Nippon Pneumatic Kogyo K.K.) in a weight of 12 kg per hour. The classified coarse powder was pulverized in a pulverizer (an ultrasonic jet mill PJM-I-10; manufactured by Nippon Pneumatic Kogyo K.K.), and, after pulverized, fed back to the first classifier. The particle size distribution of the fine powder obtained by classification in the first classifier was measured to find that the fine powder had a volume average diameter of 5.2 μm.

The resulting fine powder was fed into the second classifier (DS-5UR) and classified into median powder and fine powder. The resulting median powder had a particle size distribution of a volume average particle diameter of 5.5 μm and a coefficient of variation A of 34.0, which was collected at a rate of 6.6 kg per hour. The fine powder was obtained at a rate of 5.4 kg per hour. The classification yield was 55%.

Compared with Example 3, the resulting median powder had a very broader particle size distribution and was obtained in an extremely smaller quantity, showing that its productivity was seriously lowered. Thus, the present invention became more remarkably effective with a decrease in the particle size.

COMPARATIVE EXAMPLE 4

Classification and pulverization were carried out in the same manner as in Example 1 except that the value of weight B/weight C and the value of weight G/weight C were changed to 0.89 and 0.11, respectively. Results obtained are shown in Table 1.

COMPARATIVE EXAMPLE 5

Classification and pulverization were carried out in the same manner as in Example 1 except that the value of weight B/weight C and the value of weight G/weight C were changed to 0.2 and 0.8, respectively. Results obtained are shown in Table 1.

COMPARATIVE EXAMPLE 6

Classification and pulverization were carried out in the same manner as in Example 2 except that the value of weight B/weight C and the value of weight G/weight C were changed to 0.94 and 0.06, respectively. Results obtained are shown in Table 1.

COMPARATIVE EXAMPLE 7

Classification and pulverization were carried out in the same manner as in Example 3 except that the value of weight B/weight C and the value of weight G/weight C were changed to 0.2 and 0.8, respectively. Results obtained are shown in Table 1.

TABLE 1

| | Volume average particle diameter (μm) | Variation coefficient A | B/C | G/C | B/(F + M) | Classification yield (%) | (1) (kg/hr) |
|---|---|---|---|---|---|---|---|
| Example: | | | | | | | |
| 1 | 6.7 | 31.4 | 0.5 | 0.5 | 1.0 | 85 | 34.0 |
| 2 | 8.2 | 34.1 | 0.6 | 0.4 | 1.0 | 88 | 44.0 |
| 3 | 5.4 | 27.0 | 0.4 | 0.6 | 1.0 | 80 | 24.0 |
| Comparative Example: | | | | | | | |
| 1 | 6.8 | 34.4 | — | — | — | 60 | 14.4 |
| 2 | 8.1 | 39.4 | — | — | — | 67 | 20.0 |
| 3 | 5.5 | 34.0 | — | — | — | 55 | 6.6 |
| 4 | 6.7 | 33.0 | 0.89 | 0.11 | 1.0 | 70 | 28.0 |
| 5 | 6.8 | 32.5 | 0.2 | 0.8 | 1.0 | 65 | 26.0 |
| 6 | 8.1 | 36.0 | 0.94 | 0.06 | 1.0 | 74 | 37.0 |
| 7 | 5.6 | 28.5 | 0.2 | 0.8 | 1.0 | 65 | 19.5 |

(1): Yield of median powder M per unit time

EXAMPLE 4

Classification and pulverization were carried out in the same manner as in Example 1 except that the air current classifier as shown in FIG. 7 was used as the first classifier 9 and the impact pneumatic pulverizer as shown in FIG. 9 (the impact surface of the impact member had a conical shape with a vertical angle of 160° and had a secondary air inlet) was used as the pulverizer.

Figure 11:
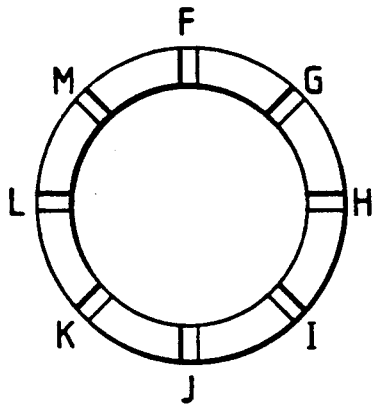

The pulverization was carried out by feeding to the impact pneumatic pulverizer, compressed air of 4.6 $m^3$/min (6 kgf/$cm^2$) from the compressed air feed nozzle and secondary air of 0.05 $Nm^3$/min (5.5 kgf/$cm^2$) from each of the six inlets F, G, H, J, L and M shown in FIG. 11. Results obtained are shown in Table 2.

EXAMPLE 5

Classification and pulverization were carried out in the same manner as in Example 1 except that the impact pneumatic pulverizer as shown in FIG. 9 (the impact surface of the impact member had a conical shape with a vertical angle of 160° and had a secondary air inlet) was used as the pulverizer.

The pulverization was carried out by feeding to the impact pneumatic pulverizer, compressed air of 4.6 $m^3$/min (6 kgf/$cm^2$) from the compressed air feed nozzle and secondary air of 0.05 $Nm^3$/min (5.5 kgf/$cm^2$) from each of the six inlets F, G, H, J, L and M shown in FIG. 11. Results obtained are shown in Table 2.

TABLE 2

| | Volume average particle diameter (μm) | Variation coefficient A | B/C | G/C | B/(F + M) | Classification yield (%) | (1) (kg/hr) |
|---|---|---|---|---|---|---|---|
| Example: | | | | | | | |
| 4 | 6.7 | 30.5 | 0.5 | 0.5 | 1.0 | 88 | 53 |
| 5 | 6.8 | 31.2 | 0.48 | 0.52 | 1.0 | 86 | 50 |

(1): Yield of median powder M per unit time

As having been described above, employment of the process and apparatus system for producing a toner according to the present invention makes it possible to obtain at a low cost a toner for developing electrostatic images, having a stable and high image density, having a good durability, being free from defective images such as fog and faulty cleaning and having a given superior particle size, compared with conventional methods. There is the advantage that a toner for developing electrostatic images, having a small particle size, can be effectively obtained.

We claim:

1. A process for producing a toner for developing an electrostatic latent image, comprising the step of;

melt-kneading a composition comprising at least a binder resin and a coloring agent, cooling the kneaded product to solidification, and pulverizing the solidified product to produce a pulverized feed material;

feeding the pulverized feed material to a first classifying means to classify the feed material into coarse powder and fine powder;

feeding the classified coarse powder to a pulverizing means and thereafter feeding back the pulverized product to the first classifying means;

introducing the classified fine powder to a second classifying means having a multi-division classification zone divided into at least three sections, to which the particles of the fine powder are allowed to fall along curved lines by the Coanda effect, where a coarse powder portion mainly comprised of particles having a particle size above a prescribed range is dividedly collected in a first divided section, a median powder portion mainly comprised of particles having a particle size within the prescribed range is dividedly collected in a second divided section, and a fine powder portion mainly comprised of particles having a particle size below the prescribed range is dividedly collected in a third divided section; and feeding back said classified coarse powder collected in the first divided section, to one of said pulverizing means and said first classifying means;

wherein said median powder collected in the second divided section has a volume average particle diameter of from 4 μm to 10 μm and a coefficient of variation of number distribution, represented by A, satisfying the following condition:

$$20 \leqq A \leqq 45$$

wherein A represents the coefficient of variation $(S/\overline{D}_1) \times 100$ in the number distribution of the median powder, wherein S represents the standard deviation in the number distribution of the median powder and $\overline{D}_1$ represents the number average particle diameter (μm) of the median powder; and when the weight per unit time of the pulverized feed material fed to the first classifying means is represented by B, the weight per unit time of the fine powder introduced to the second classifying means is represented by C, the weight per unit time of the coarse powder collected in the first divided section and fed back to the pulverizing means or the first classifying means is represented by G, the weight per unit time of the median powder collected in the second divided section is represented by M and the weight per unit time of the fine powder collected in the third divided section is represented by F, the weights B, C, F, G and M are controlled to satisfy the following expressions:

$0.3 \leqq$ weight B/weight C $\leqq 0.8$, $0.2 \leqq$ weight G/weight C $\leqq 0.7$, and $0.8 \leqq$ weight B/(weight F + weight M) $\leqq 1.2$.

2. The process according to claim 1, wherein said pulverized feed material comprises a particle having a particle diameter of no more than 2 mm.

3. The process according to claim 1, wherein said pulverized feed material comprises a particle having a particle diameter of no more than 1 mm.

4. The process according to claim 1, wherein said median powder has a volume average particle diameter of from 4 μm to 9 μm.

5. The process according to claim 1, wherein said coarse powder collected in the first divided. section is fed into said pulverizing means.

6. The process according to claim 1, wherein said coarse powder collected in the first divided section is fed into said first classifying means together with a pulverized feed material.

7. The process according to claim 1, wherein said first classifying means comprises;

a powder feed cylinder and a classifying chamber, provided in said classifying means;

a guide chamber provided at an upper part of said classifying chamber to communicate with said powder feed cylinder;

a plurality of introducing louvers provided between said guide chamber and said classifying chamber, at which the powder is flowed in from said guide chamber to said classifying chamber through openings between said introducing louvers together with carrying air;

an inclined classifying plate raised at its central part, provided at the bottom of said classifying chamber;

classifying louvers provided along the side wall of said classifying chamber, through openings of which the air is flowed to produce a whirling stream by which said powder fed into said classifying chamber together with carrying air is centrifugally separated into fine powder and coarse powder;

a discharge opening provided at the central part of said classifying plate and from which the classified fine powder is discharged;

a fine powder discharge chute connected to said discharge opening; and a discharge opening formed along the periphery of said classifying plate and from which the classified coarse powder is discharged.

8. The process according to claim 1, wherein said pulverizing means comprises an impact pneumatic pulverizer.

9. The process according to claim 8, wherein the pneumatic pulverizer comprises an accelerating tube for transporting powders under acceleration by the action of a high-pressure gas, a pulverizing chamber, an impact member for pulverizing the powder ejected from the accelerating tube by the force of impact, the impact member being provided opposingly to the outlet of the accelerating tube, a powder feed opening provided on the accelerating tube, and a secondary air inlet provided between the powder feed opening and the outlet of the accelerating tube.

10. The process according to claim 1, wherein said first classifying means comprises;

a powder feed cylinder and a classifying chamber, provided in said classifying means;

a guide chamber provided at an upper part of said classifying chamber to communicate with said powder feed cylinder;

a plurality of introducing louvers provided between said guide chamber and said classifying chamber, at which the powder is flowed in from said guide chamber to said classifying chamber through openings between said introducing louvers together with carrying air;

an inclined classifying plate raised at its central part, provided at the bottom of said classifying chamber;

classifying louvers provided along the side wall of said classifying chamber, through openings of which the air is flowed to produce a whirling stream by which said powder fed into said classifying chamber together with carrying air is centrifugally separated into fine powder and coarse powder;

a discharge opening provide at the central part of classifying plate and from which the classified fine powder is discharged;

a fine powder discharge chute connected to said discharge opening; and a discharge opening formed along the periphery of said classifying plate and from which the classified coarse powder is discharged;

and said pulverizing means comprises an impact pneumatic pulverizer. said pneumatic pulverizer comprising an accelerating tube for transporting powders under acceleration by the action of a high-pressure gas, a pulverizing chamber, an impact member for pulverizing the powder ejected from the accelerating tube by the force of impact, the impact member being provided opposingly to the outlet of the accelerating tube, a powder feed opening provided on the accelerating tube, and a secondary air inlet provided between the powder feed opening and the outlet of the accelerating tube.

11. An apparatus system for producing a toner for developing an electrostatic image, comprising:

a first constant-feeding means for constantly feeding a pulverized feed material;

a first control means for controlling the quantity of the pulverized feed material fed from said first constant-feeding means;

a feeding means for feeding the coarse powder classified through said multi-division classifying means to one of said pulverizing means and said first classifying means; and a microcomputer for controlling said first control means and said second control means according to information from said detecting means.

12. The apparatus system according to claim 11, wherein said first classifying means comprises;

a powder feed cylinder and a classifying chamber, provided in said classifying means;

a guide chamber provided at an upper part of said classifying chamber to communicate with said powder feed cylinder;

a plurality of introducing louvers provided between said guide chamber and said classifying chamber, at which the powder is flowed in from said guide chamber to said classifying chamber through openings between said introducing louvers together with carrying air;

an inclined classifying plate raised at its central part, provided at the bottom of said classifying chamber;

classifying louvers provided along the side wall of said classifying chamber. through openings of which the air is flowed to produce a whirling stream by which said powder fed into said classifying chamber together with carrying air is centrifugally separated into fine powder and coarse powder;

a discharge opening provided at the central part of said classifying plate and from which the classified fine powder is discharged;

a fine powder discharge chute connected to said discharge opening; and a discharge opening formed along the periphery of said classifying plate and from which the classified coarse powder is discharged.

13. The apparatus system according to claim 11, wherein said pulverizing means comprises an impact pneumatic pulverizer.

14. The apparatus system according to claim 13, wherein the pneumatic pulverizer comprises an accelerating tube for transporting powders under acceleration by the action of a high-pressure gas, a pulverizing chamber, an impact member for pulverizing the powder ejected from the accelerating tube by the force of impact, the impact member being provided opposingly to the outlet of the accelerating tube, a powder feed opening provided on the accelerating tube, and a secondary air inlet provided between the powder feed opening and the outlet of the accelerating tube.

15. The apparatus system according to claim 2, wherein said first classifying means comprises;

a powder feed cylinder and a classifying chamber, provided in said classifying means;

a guide chamber provided at an upper part of said classifying chamber to communicate with said powder feed cylinder;

a plurality of introducing louvers provided between said guide chamber and said classifying chamber, at which the powder is flowed in from said guide chamber to said classifying chamber through openings between said introducing louvers together with carrying air;

an inclined classifying plate raised at its central part, provided at the bottom of said classifying chamber;

classifying louvers provided along the side wall of said classifying chamber ,through openings of which the air is flowed to produce a whirling stream by which said powder fed into said classifying chamber together with carrying air is centrifugally separated into fine powder and coarse powder;

a discharge opening provided at the central a first classifying means for classifying the pulverized feed material fed from said first constant-feeding means, into coarse powder and fine powder;

a pulverizing means for pulverizing the coarse powder classified through said first classifying means;

an introducing means for introducing a powder pulverized through said pulverizing means to said first classifying means;

a multi-division classifying means for classifying the fine powder classified through said first classifying means, into at least coarse powder, median powder and fine powder by the Coanda effect;

a second constant-feeding means for constantly feeding said fine powder classified through said first classifying means, to said multi-division classifying means;

a detecting means for detecting the quantity of the fine powder held in said second constant-feeding means;

a second control means for controlling the quantity of the fine powder fed from said second constant-feeding means;

an introducing means for introducing said fine powder at a high velocity to said multi-division classifying means; part of said classifying plate and from which the classified fine powder is discharged;

a fine powder discharge chute connected to said discharge opening; and a discharge opening formed along the periphery of said classifying plate and from which the classified coarse powder is discharged;

and said pulverizing means comprises a impact pneumatic pulverizer, said pneumatic pulverizer comprising an accelerating tube for transporting powders under acceleration by the action of a high-pressure gas, a pulverizing chamber, an impact member for pulverizing the powder ejected from the accelerating tube by the force of impact, the impact member being provided opposingly to the outlet of the accelerating tube, a powder feed opening provided on the accelerating tube, and a secondary air inlet provided between the powder feed opening and the outlet of the accelerating tube.

* * * * *

UNITED STATES PATENT AND TRADEMARK OFFICE

CERTIFICATE OF CORRECTION

PATENT NO. : 5,111,998

DATED : May 12, 1992

INVENTOR(S) : HITOSHI KANDA, ET AL.

It is certified that error appears in the above-identified patent and that said Letters Patent is hereby corrected as shown below:

COLUMN 7

Line 17, "of means" should read --by means--.
Line 45, "an" should read --a--.

COLUMN 8

Line 53, "obtained." should read --obtained,--.

COLUMN 9

Line 11, "feeder 01," should read --feeder 10,--.

COLUMN 10

Line 5, "section" should read --suction--.
Line 13, "air" should read --The air--.

COLUMN 11

Line 4, "form" should read --from--.
Line 39, "provide" should read --provided--.
Line 45, "coanda" should read --Coanda--.

COLUMN 12

Line 7, "inner diameter of the" should be deleted.
Line 67, "the" (first occurrence) should read --The--.

COLUMN 14

Line 47, "kind" should read --kinds--.

--

UNITED STATES PATENT AND TRADEMARK OFFICE

CERTIFICATE OF CORRECTION

PATENT NO. : 5,111,998

DATED : May 12, 1992

INVENTOR(S) : HITOSHI KANDA, ET AL.

It is certified that error appears in the above-identified patent and that said Letters Patent is hereby corrected as shown below:

COLUMN 15

Line 15, "4 ∝m" should --4 μm--.
Line 61, "the" (first occurrence) should read --The--.

COLUMN 19

Line 12, "of;" should read --of:--.

COLUMN 20

Line 16, "divided." should read --divided--.
Line 23, "comprises;" should read --comprises:--.
Line 68, "comprises;" should read --comprises:--.

COLUMN 21

Line 21, "provide" should read --provided-- and "of" should read --of said--.
Line 43, "comprising;" should read --comprising:--.
Line 48, "constant-feeding means;" should read --constant-feeding means;

a first classifying means for classifying the pulverized feed material fed from said first constant-feeding means, into coarse powder and fine powder;

a pulverizing means for pulverizing the coarse powder classified through said first classifying means;

an introducing means for introducing a powder pulverized through said pulverizing means to said first classifying means;

UNITED STATES PATENT AND TRADEMARK OFFICE

CERTIFICATE OF CORRECTION

PATENT NO. : 5,111,998

DATED : May 12, 1992

INVENTOR(S) : HITOSHI KANDA, ET AL.

It is certified that error appears in the above-identified patent and that said Letters Patent is hereby corrected as shown below:

COLUMN 21

Line 48 (continued), a multi-division classifying means for classifying the fine powder classified through said first classifying means, into at least coarse powder, median powder and fine powder by the Coanda effect;

a second constant-feeding means for constantly feeding said fine powder classified through said first classifying means, to said multi-division classifying means;

a detecting means for detecting the quantity of the fine powder held in said second constant-feeding means;

a second control means for controlling the quantity of the fine powder fed from said second constant-feeding means;

an introducing means for introducing said fine powder at a high velocity to said multi-division classifying means;--.

COLUMN 21

Line 57, "comprises;" should read --comprises:--.

COLUMN 22

Line 32, "claim 2," should read --claim 11,--.
Line 48, "chamber ,through" should read --chamber, through--.
Lines 55-68 should be deleted.

--

UNITED STATES PATENT AND TRADEMARK OFFICE

CERTIFICATE OF CORRECTION

PATENT NO. : 5,111,998

DATED : May 12, 1992

INVENTOR(S) : HITOSHI KANDA, ET AL.

It is certified that error appears in the above-identified patent and that said Letters Patent is hereby corrected as shown below:

COLUMN 23

Lines 1-11 should be deleted.
Line 12, "ing means;" should be deleted.

COLUMN 24

Line 4, "a impact" should read --an impact--.

Signed and Sealed this

Seventh Day of September, 1993

Bruce Lehman

*Attest:*

BRUCE LEHMAN

*Attesting Officer*

*Commissioner of Patents and Trademarks*